US011116268B2

(12) United States Patent
Etzler

(10) Patent No.: US 11,116,268 B2
(45) Date of Patent: Sep. 14, 2021

(54) STITCH RIPPING ASSEMBLY

(71) Applicant: Ronald J. Etzler, Needville, TX (US)

(72) Inventor: Ronald J. Etzler, Needville, TX (US)

( * ) Notice: Subject to any disclaimer, the term of this patent is extended or adjusted under 35 U.S.C. 154(b) by 22 days.

(21) Appl. No.: 16/701,901

(22) Filed: Dec. 3, 2019

(65) Prior Publication Data

US 2021/0161234 A1 Jun. 3, 2021

(51) Int. Cl.

| | |
|---|---|
| ***B26D 3/00*** | (2006.01) |
| ***B26D 3/08*** | (2006.01) |
| ***D05B 57/00*** | (2006.01) |
| ***A41H 31/00*** | (2006.01) |
| ***D05B 89/00*** | (2006.01) |

(52) U.S. Cl.

CPC ..... *A41H 31/005* (2013.01); *D05B 89/00* (2013.01)

(58) Field of Classification Search

CPC . B26F 1/36; B26F 1/04; B26F 1/3846; B26D 7/015; B26D 5/10; B26D 1/226; B26D 1/225; B28D 1/30; B26B 29/06; B43L 11/04; Y10T 83/699; Y10T 83/6995; Y10T 83/8889; Y10T 83/8791; Y10T 83/0385

USPC ..... 30/394, 208, 209, 210, 226, 227, 164.9, 30/310, 164.75; 83/879, 468, 455, 456, 83/886; 33/42, 27.03; 112/122, 128, 112/129, 252

See application file for complete search history.

(56) References Cited

U.S. PATENT DOCUMENTS

| | | | | |
|---|---|---|---|---|
| D175,388 | S | 3/1876 | St. George | |
| D322,299 | S | 7/1885 | Lavigne | |
| D370,456 | S | 9/1887 | Doughty | |
| D560,616 | S | 5/1896 | Hudgins | |
| D709,917 | S | 9/1902 | Marshall | |
| D914,130 | S | 3/1909 | Freeman | |
| 2,735,486 | A * | 2/1956 | Millard | B26F 1/3846 408/93 |
| 2,764,814 | A | 10/1956 | Jecker | |
| 3,100,935 | A | 8/1963 | Leafe | |
| 3,756,175 | A | 9/1973 | Rogers | |
| 4,044,464 | A * | 8/1977 | Schiess | B23B 51/05 30/164.9 |
| 4,858,322 | A * | 8/1989 | Kluga | B26B 27/00 30/310 |
| 4,911,051 | A * | 3/1990 | Depetris | A61B 17/32053 30/310 |
| 6,158,133 | A * | 12/2000 | Carlson | B26B 29/06 30/300 |
| D820,582 | S | 6/2018 | Farnum | |
| 2008/0041757 | A1* | 2/2008 | Nelson | A47J 47/005 206/553 |
| 2011/0302792 | A1* | 12/2011 | Exley | B26F 1/3846 30/310 |

* cited by examiner

*Primary Examiner* — Ghassem Alie

(57) ABSTRACT

A stitch ripping assembly for hands free stitch ripping includes a base that is positionable on a support surface. The base is rounded and is elongated along a longitudinal axis such that the base has an ovoid shape. Additionally, the base has a prominence extending upwardly therefrom. A gripping pad is coupled to the base and the gripping pad is comprised of an adhesive material to inhibit the base from sliding on the support surface. A stitch ripper is pivotally coupled to the base. The stitch ripper is positionable to extend upwardly from the base at a plurality of angles. In this way the stitch ripper can rip stitches without being held by a user.

5 Claims, 6 Drawing Sheets

STITCH RIPPING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ripping devices and more particularly pertains to a new ripping device for hands free stitch ripping.

(2) Description of Related Art Including Information Disclosed Under 37 CFR 1.97 and 1.98

The prior art relates to ripping devices. The prior art discloses a variety of stitch rippers that include a clamping mechanism for engaging an edge of a table. The prior art also discloses a variety of stitch rippers that each has a unique design with respect to a cutting end of the stitch rippers. Additionally, the prior art discloses a stitch ripper that hingedly integrated into a sewing machine table. The prior art discloses a stitch ripper that is attached to a leg band thereby facilitating the stitch ripper to be positioned on a user's legs while the user is seated.

BRIEF SUMMARY OF THE INVENTION

An embodiment of the disclosure meets the needs presented above by generally comprising a base that is positionable on a support surface. The base is rounded and is elongated along a longitudinal axis such that the base has an ovoid shape. Additionally, the base has a prominence extending upwardly therefrom. A gripping pad is coupled to the base and the gripping pad is comprised of an adhesive material to inhibit the base from sliding on the support surface. A stitch ripper is pivotally coupled to the base. The stitch ripper is positionable to extend upwardly from the base at a plurality of angles. In this way the stitch ripper can rip stitches without being held by a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
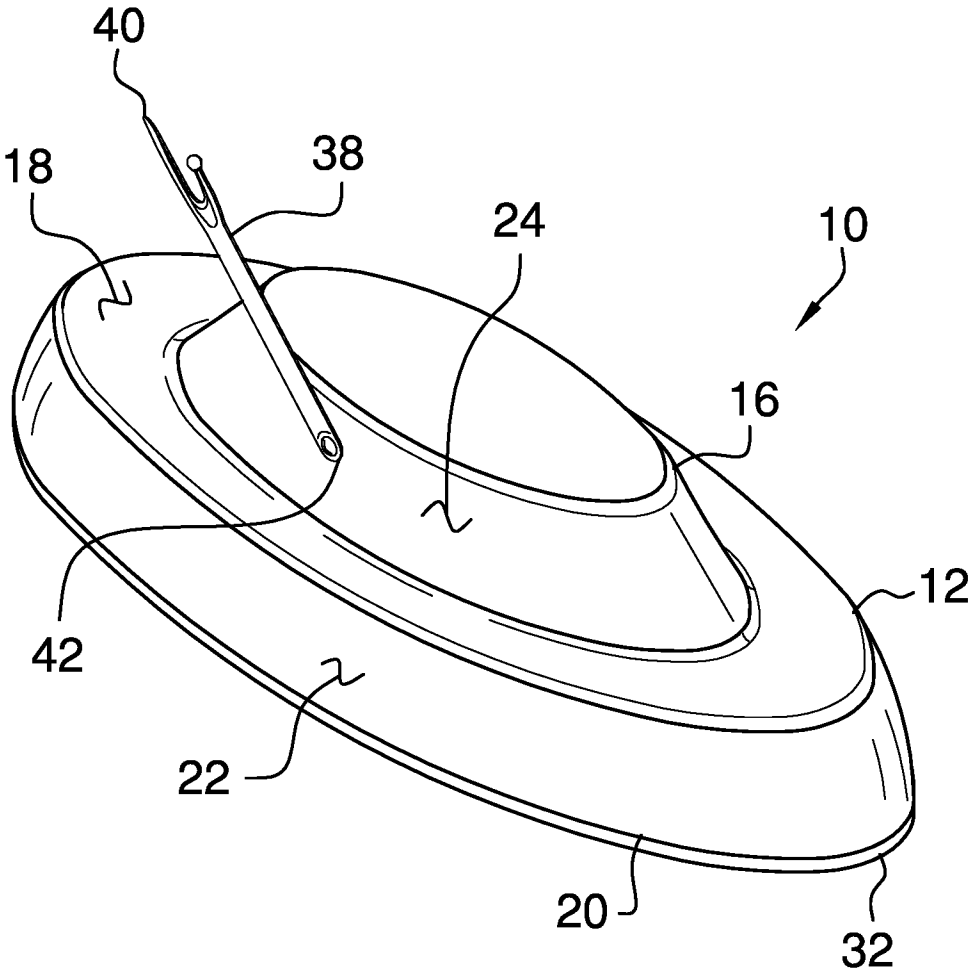
FIG. 1 is a top perspective view of a stitch ripping assembly according to an embodiment of the disclosure.
Figure 2:
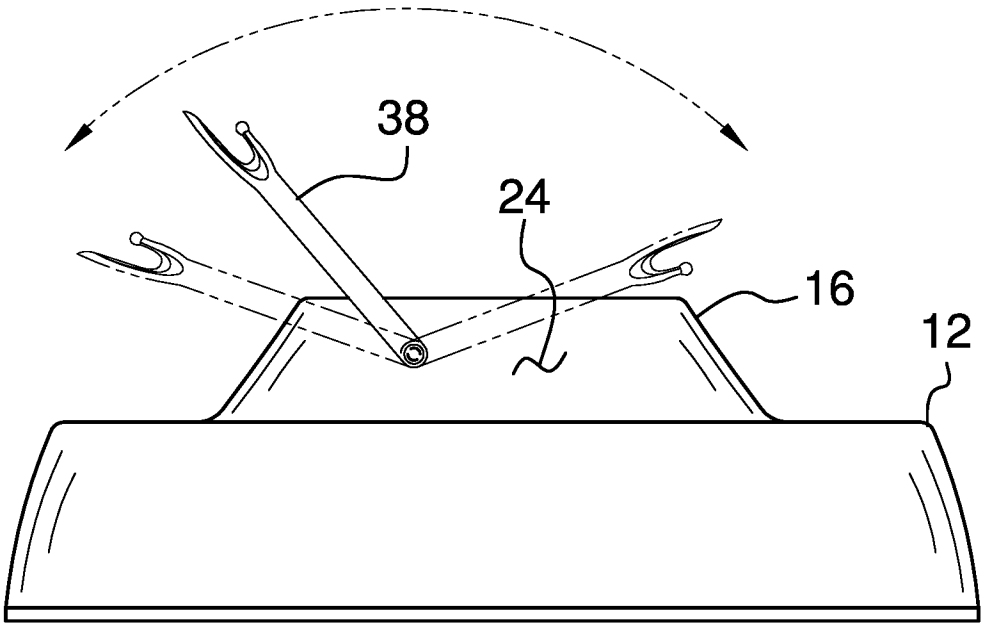
FIG. 2 is a left side view of an embodiment of the disclosure.
Figure 3:
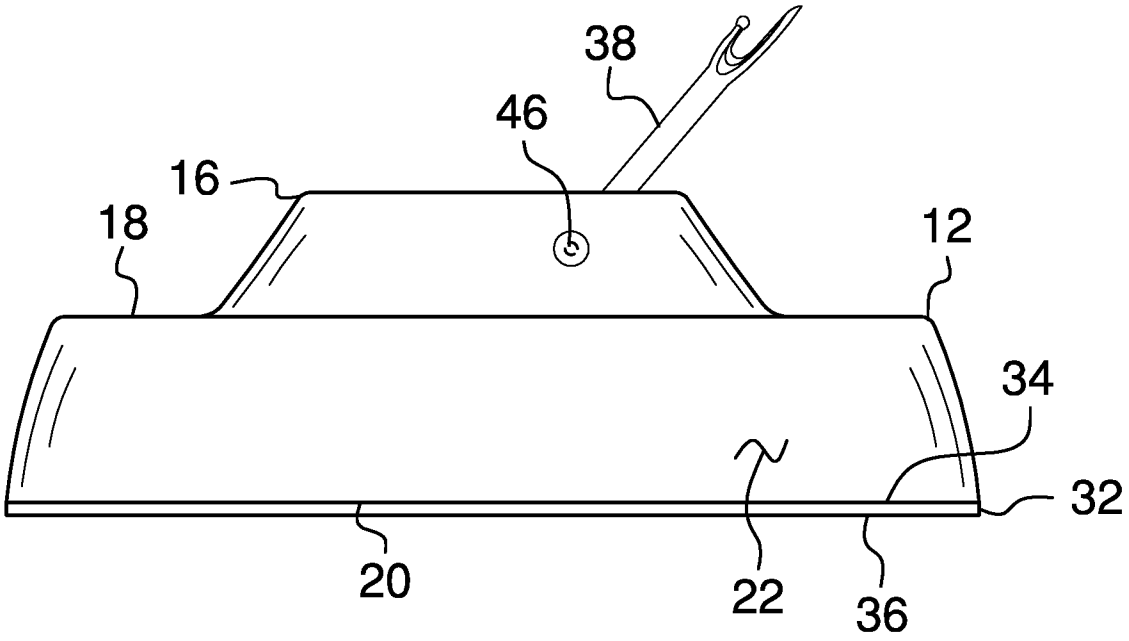
FIG. 3 is a right side view of an embodiment of the disclosure.
Figure 4:
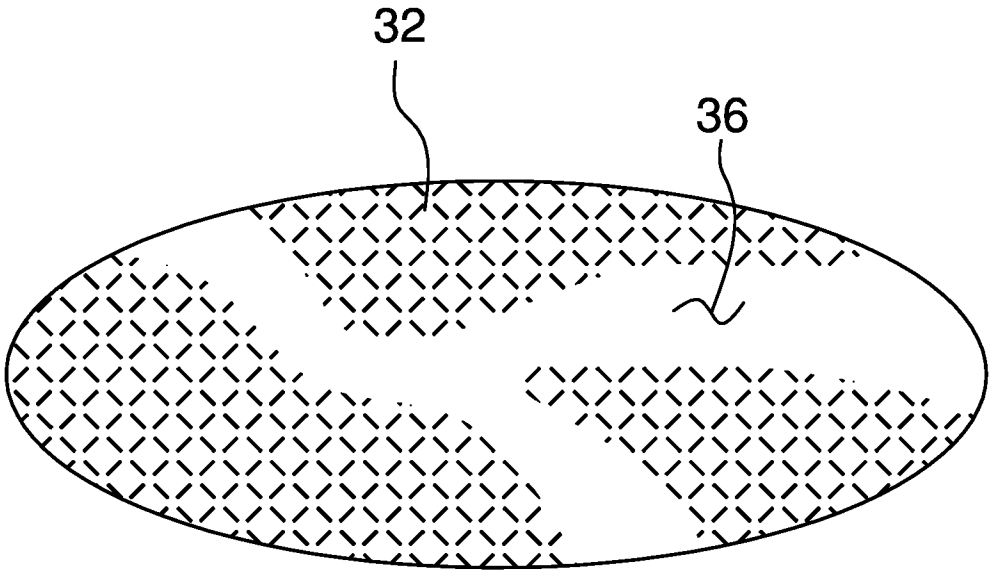
FIG. 4 is a bottom view of an embodiment of the disclosure.
Figure 5:
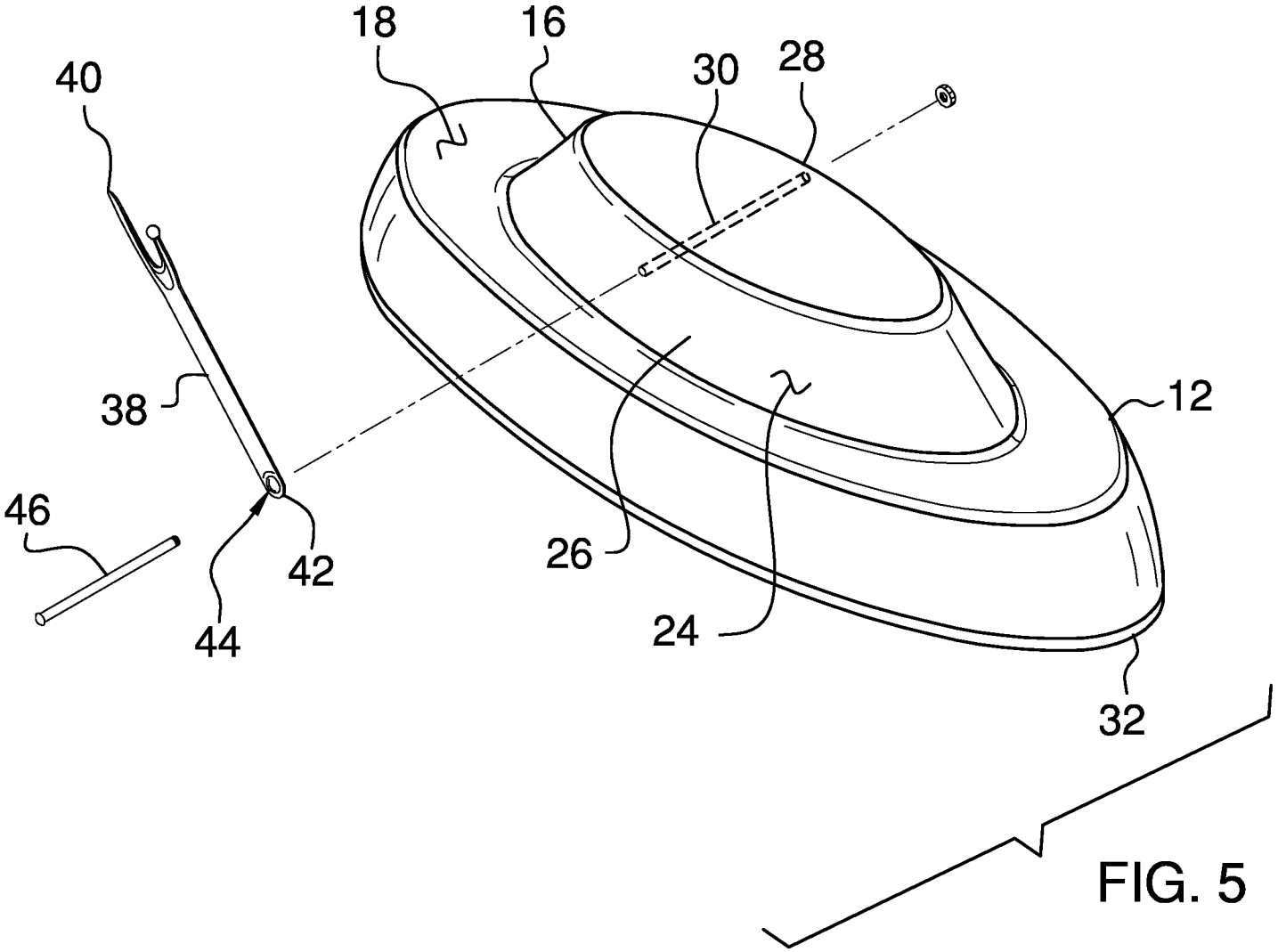
FIG. 5 is an exploded perspective view of an embodiment of the disclosure.
Figure 6:
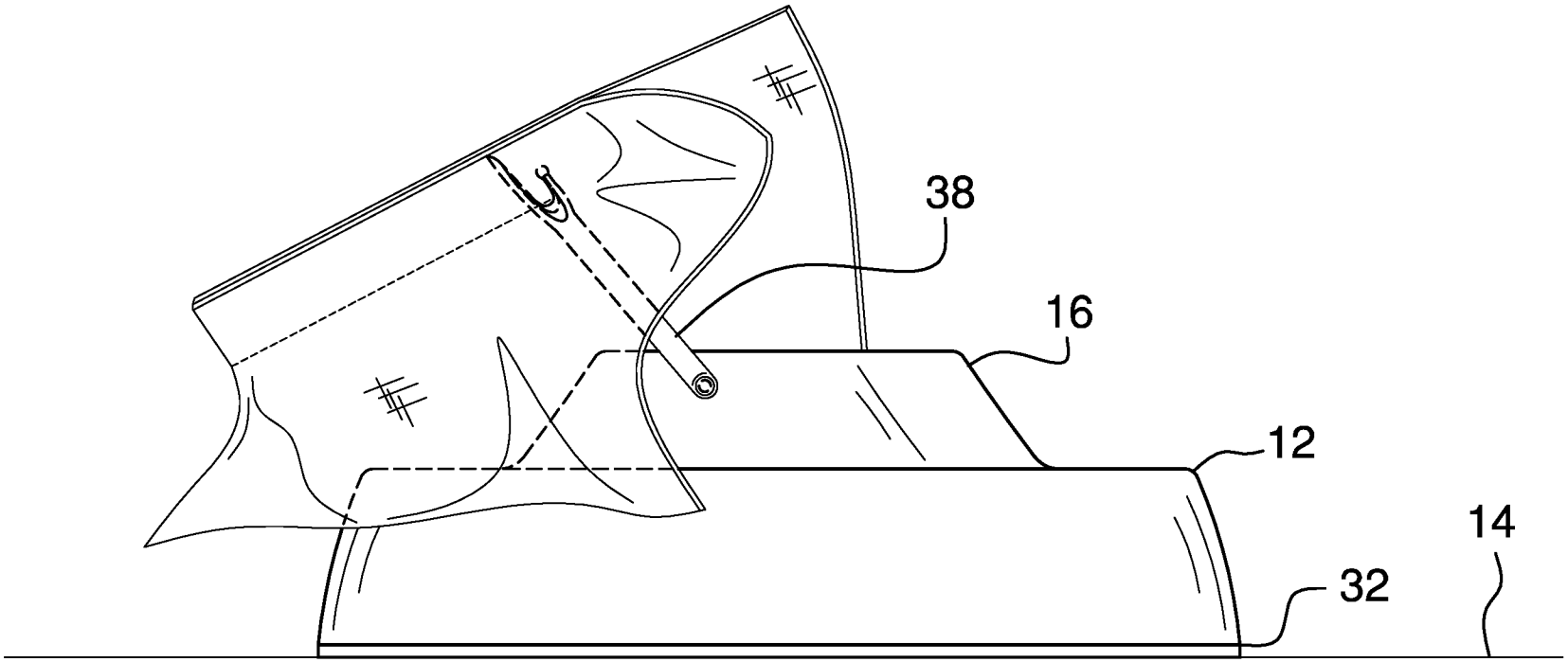
FIG. 6 is a perspective in-use view of an embodiment of the disclosure.

With reference now to the drawings, and in particular to FIGS. 1 through 6 thereof, a new ripping device embodying the principles and concepts of an embodiment of the disclosure and generally designated by the reference numeral 10 will be described.

As best illustrated in FIGS. 1 through 6, the stitch ripping assembly 10 generally comprises a base 12 that is positionable on a support surface 14 such as a table top or the like. The base 12 is rounded and the base 12 is elongated along a longitudinal axis such that the base 12 has an ovoid shape. The ovoid shape of the base 12 inhibits the base 12 from being tipped lengthwise on the support surface 14. The base 12 has a prominence 16 extending upwardly therefrom. The base 12 has a top surface 18, a bottom surface 20 and a perimeter surface 22 extending therebetween. The perimeter surface 22 is arcuate about the longitudinal axis. The prominence 16 has an outer surface 24 and the outer surface 24 has a first lateral side 26 and a second lateral side 28. The prominence 16 has an aperture 30 extending through the first lateral side 26 and the second lateral side 28.

A gripping pad 32 is coupled to the base 12 and the gripping pad 32 is comprised of an adhesive material. In this way the gripping pad 32 can frictionally engage the support surface 14 thereby inhibiting the base 12 from sliding on the support surface 14. The gripping pad 32 has an upper surface 34 and a lower surface 36, and the upper surface 34 is bonded to the bottom surface 20 of the base 12. The gripping pad 32 completely covers the bottom surface 20 and the lower surface 36 engages the support surface 14.

A stitch ripper 38 is provided that has a cutting end 40 and a fastening end 42. The stitch ripper 38 is pivotally coupled to the base 12. Additionally, the stitch ripper 38 is positionable to extend upwardly from the base 12 at a plurality of angles. In this way the stitch ripper 38 can rip stitches without being held by a user. The stitch ripper 38 has a hole 44 extending therethrough and the hole 44 is positioned adjacent to the fastening end 42. A fastener 46 is provided and the fastener 46 extends through the hole 44 in the stitch ripper 38 and the aperture 30 in the outer surface 24 of the prominence 16. Thus, the cutting end 40 of the stitch ripper 38 is directed upwardly from the prominence 16.

In use, the base 12 is positioned on a support surface 14 and the stitch ripper 38 is rotated into a preferred orientation. Thus, the user can use both hands to guide stitched fabric across the cutting end 40 of the stitch ripper 38 for cutting stitching in the fabric. In this way the base 12 and the stitch ripper 38 enhance cutting stitches for physically limited users, such as elderly users or physically disabled users. Additionally, the gripping pad 32 inhibits the base 12 from sliding along the support surface 14 while the stitched fabric is drawn across the cutting end 40 of the stitch ripper 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stitch ripping assembly being configured to be placed at a fixed location thereby facilitating hands free use of a stitch ripper, said assembly comprising:

a base being positionable on a support surface, said base being rounded and being elongated along a longitudinal axis such that said base has an ovoid shape, said base having a prominence extending upwardly therefrom;

a gripping pad being coupled to said base, said gripping pad being comprised of an adhesive material wherein said gripping pad is configured to frictionally engage the support surface thereby inhibiting said base from sliding on the support surface; and a stitch ripper being pivotally coupled to said base, said stitch ripper being positionable to extend upwardly from said base at a plurality of angles wherein said stitch ripper is configured to rip stitches without being held by a user, said stitch ripper having a cutting end and a fastening end, said cutting end having a pair of spaced terminal ends and a U-shaped sharpened edge extending between the terminal ends such that the sharpened edge faces away from the fastening end, said stitch ripper having a hole extending therethrough, said hole being positioned adjacent to said fastening end.

2. The assembly according to claim 1, wherein said base has a top surface, a bottom surface and a perimeter surface extending therebetween, said perimeter surface being arcuate about the longitudinal axis, said prominence having an outer surface, said outer surface having a first lateral side and a second lateral side, said prominence having an aperture extending through said first lateral side and said second lateral side.

3. The assembly according to claim 2, wherein said gripping pad has an upper surface and a lower surface, said upper surface being bonded to said bottom surface of said base, said gripping pad completely covering said bottom surface, said lower surface engaging the support surface.

4. The assembly according to claim 1, further comprising a fastener extending through said hole in said stitch ripper and said aperture in said outer surface of said prominence, said cutting end of said stitch ripper being directed upwardly from said prominence.

5. A stitch ripping assembly being configured to be placed at a fixed location thereby facilitating hands free use of a stitch ripper, said assembly comprising:

a base being positionable on a support surface, said base being rounded and being elongated along a longitudinal axis such that said base has an ovoid shape, said base having a prominence extending upwardly therefrom, said base having a top surface, a bottom surface and a perimeter surface extending therebetween, said perimeter surface being arcuate about the longitudinal axis, said prominence having an outer surface, said outer surface having a first lateral side and a second lateral side, said prominence having an aperture extending through said first lateral side and said second lateral side;

a gripping pad being coupled to said base, said gripping pad being comprised of an adhesive material wherein said gripping pad is configured to frictionally engage the support surface thereby inhibiting said base from sliding on the support surface, said gripping pad having an upper surface and a lower surface, said upper surface being bonded to said bottom surface of said base, said gripping pad completely covering said bottom surface, said lower surface engaging the support surface;

a stitch ripper having a cutting end and a fastening end, said cutting end having a pair of spaced terminal ends and a U-shaped sharpened edge extending between the terminal ends such that the sharpened edge faces away from the fastening end, said stitch ripper being pivotally coupled to said base, said stitch ripper being positionable to extend upwardly from said base at a plurality of angles wherein said stitch ripper is configured to rip stitches without being held by a user, said stitch ripper having a hole extending therethrough, said hole being positioned adjacent to said fastening end; and a fastener extending through said hole in said stitch ripper and said aperture in said outer surface of said prominence said cutting end of said stitch ripper being directed upwardly from said prominence.

* * * * *